US010494880B2

(12) United States Patent
Blair et al.

(10) Patent No.: US 10,494,880 B2
(45) Date of Patent: Dec. 3, 2019

(54) ELECTRONICALLY CONTROLLED REEL SYSTEM FOR OILFIELD OPERATIONS

(71) Applicant: Cameron International Corporation, Houston, TX (US)

(72) Inventors: Justin Blair, Houston, TX (US); Nathan Cooper, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 206 days.

(21) Appl. No.: 15/285,187

(22) Filed: Oct. 4, 2016

(65) Prior Publication Data

US 2017/0096864 A1 Apr. 6, 2017

Related U.S. Application Data

(60) Provisional application No. 62/237,373, filed on Oct. 5, 2015.

(51) Int. Cl.

| | |
|---|---|
| ***E21B 19/00*** | (2006.01) |
| ***B65H 75/44*** | (2006.01) |
| ***B65H 75/42*** | (2006.01) |

(52) U.S. Cl.

CPC ..... *E21B 19/008* (2013.01); *B65H 75/425* (2013.01); *B65H 75/4484* (2013.01); *B65H 75/4486* (2013.01); *B65H 2701/34* (2013.01)

(58) Field of Classification Search

CPC . E21B 19/008; B65H 75/425; B65H 75/4484; B65H 75/4486; B65H 2701/34; B66C 13/50; B66D 1/485

See application file for complete search history.

(56) References Cited

U.S. PATENT DOCUMENTS

| | | | | |
|---|---|---|---|---|
| 3,801,071 A * | 4/1974 | Barron | B63B 21/56 | 114/254 |
| 3,843,096 A * | 10/1974 | Wilson | B66D 1/50 | 175/5 |
| 3,901,478 A * | 8/1975 | Peterson | B66C 13/02 | 188/71.2 |
| 3,934,655 A * | 1/1976 | Whistle | B65H 49/32 | 173/46 |
| 3,982,160 A * | 9/1976 | Goldschmidt | G11B 15/43 | 318/7 |
| 4,105,934 A * | 8/1978 | Jenkins | G11B 15/43 | 318/113 |

(Continued)

OTHER PUBLICATIONS

International Preliminary Report on Patentability for the equivalent international patent application PCT/US2016/055432 dated Apr. 19, 2018.

(Continued)

*Primary Examiner* — Michael E Gallion
(74) *Attorney, Agent, or Firm* — Helene Raybaud

(57) ABSTRACT

A system and method for electronically controlling a reel system for oilfield operations. The electronically controlled reel system for oilfield operations comprises a reel, and an electronic control system in communication with the reel to electronically control rotation of the reel. The method of controlling a reel for an oilfield operation comprises receiving a command from an electronic control system; and supplying an electrical control signal to the reel based on the command to control rotation of the reel.

16 Claims, 6 Drawing Sheets

(56) References Cited

U.S. PATENT DOCUMENTS 4,241,884 A * 12/1980 Lynch ..... B65H 49/34 241/73
4,261,451 A * 4/1981 Strong ..... B66D 1/44 192/12 R
4,491,186 A * 1/1985 Alder ..... E21B 19/08 173/9
4,508,281 A * 4/1985 Plater ..... B65H 59/381 242/390.6
4,624,450 A * 11/1986 Christison ..... B66D 1/52 254/272
4,871,131 A * 10/1989 Bernier ..... B64D 25/06 244/122 AG
5,398,911 A * 3/1995 Holster ..... B65G 23/44 192/12 B
6,171,066 B1 * 1/2001 Irokawa ..... F15B 9/09 137/84
6,328,502 B1 * 12/2001 Hickey ..... B63B 35/03 405/168.3
6,775,204 B2 * 8/2004 Scott ..... H02G 1/06 367/17
7,225,878 B2 * 6/2007 Holcomb ..... E21B 37/10 166/105
7,594,640 B1 * 9/2009 Mann ..... B66D 1/26 254/278
9,206,658 B1 * 12/2015 Dion ..... E21B 19/22
2004/0162658 A1 * 8/2004 Newman ..... B66C 13/50 701/50
2005/0114001 A1 * 5/2005 Newman ..... B66C 13/50 701/50
2006/0240933 A1 * 10/2006 Shan ..... B66D 1/22 475/204
2006/0247085 A1 * 11/2006 Shan ..... B66C 19/002 475/204
2008/0302289 A1 * 12/2008 Mann ..... B66D 1/7426 114/102.1
2014/0014317 A1 * 1/2014 Aarsland ..... E21B 19/22 166/77.2
2014/0174716 A1 * 6/2014 Talgo ..... E21B 33/037 166/65.1
2014/0271075 A1 * 9/2014 Pusheck ..... E02F 3/308 414/694
2016/0362945 A1 * 12/2016 Baugh ..... E21B 19/22
2016/0362948 A1 * 12/2016 Baugh ..... E21B 17/01
2018/0023354 A1 * 1/2018 Dion ..... G05B 15/02 166/363

OTHER PUBLICATIONS

International Search Report and Written Opinion issued in corresponding application No. PCT/US2016/055432 dated Jan. 23, 2017, 16 pgs.

* cited by examiner

ELECTRONICALLY CONTROLLED REEL SYSTEM FOR OILFIELD OPERATIONS

BACKGROUND

This section is intended to provide background information to facilitate a better understanding of the various aspects of the described embodiments. Accordingly, it should be understood that these statements are to be read in this light and not as admissions of prior art.

Many oil and gas operations involve the deployment of cable downhole in a well, whether the well is a surface or subsea well. The cable may be stored on a reel at a well site or on an offshore platform. The reel is rotated to either unspool and lower the cable into or wind and raise the cable from the well. Such reels may be controlled hydraulically or pneumatically and/or require manual intervention.

BRIEF DESCRIPTION OF THE DRAWINGS

For a detailed description of the embodiments of the invention, reference will now be made to the accompanying drawings in which.

DETAILED DESCRIPTION

This disclosure provides methods and systems for electronically controlling the deployment or retrieval of a cable from a reel in an oilfield environment. The methods and systems provided herein can be applied to a variety of cable types, including but not limited to, umbilical cables, wireline cables, fishing wires, and the like. The methods and system provided herein can be used in land-based surface wells as well as offshore subsea operations.

Figure 1A:
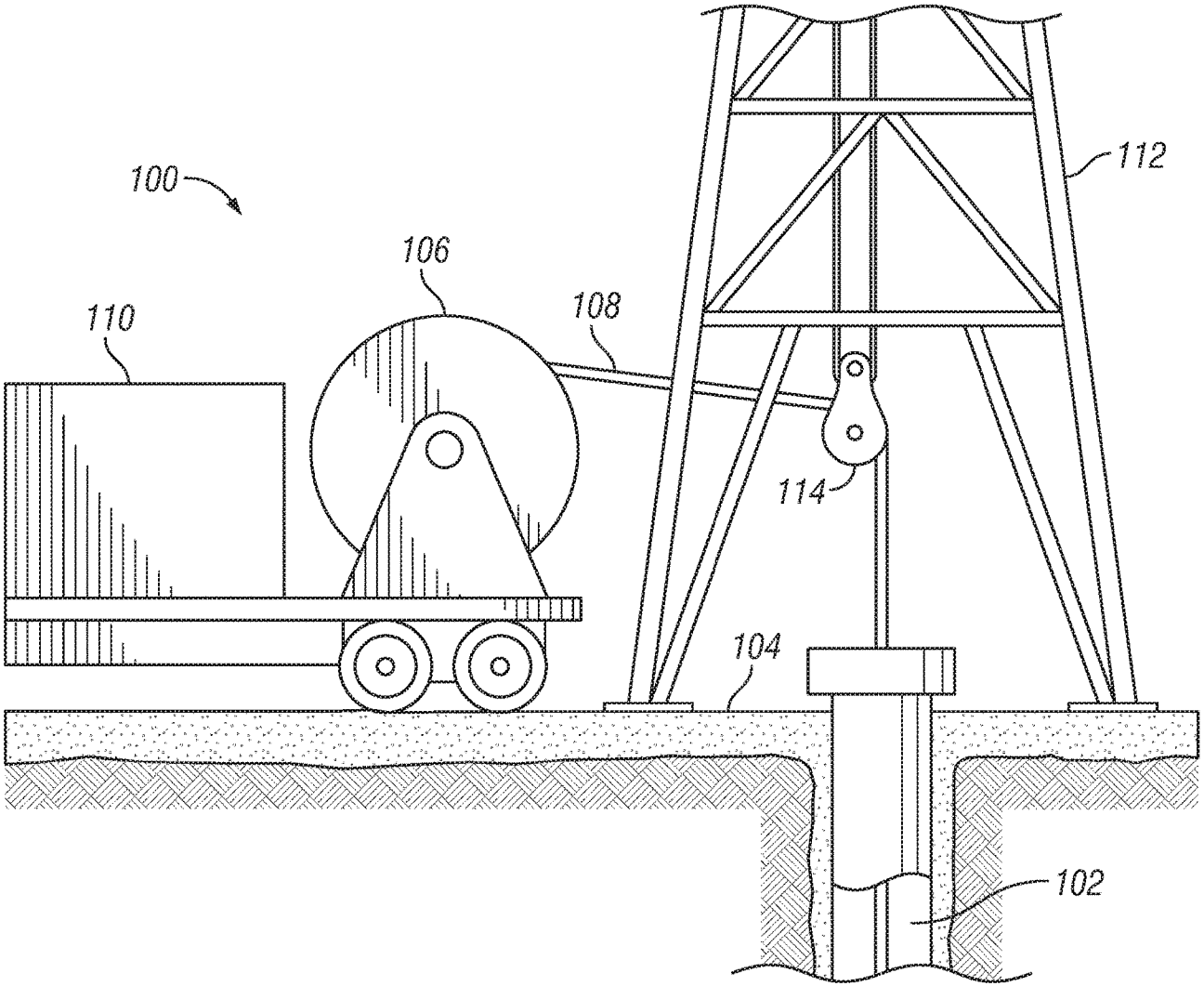
FIG. 1A depicts a schematic of a well system including an electronic reel system in accordance with one or more embodiments.

Referring to the figures, FIG. 1A depicts a schematic view of a well system including an electronically controlled reel system 100, in accordance with one or more embodiments. In such embodiments, the reel system 100 is located at a well site 104 having a well 102. In one or more embodiments, such as in the case of an offshore application, the reel system 100 may be located on an offshore vessel or structure as further described herein with respect to FIG. 1B. The reel system 100 includes a reel 106 on which a cable 108 is spooled and a control system 110 for controlling operation of the reel 106. The control system 110 may include a user interface for receiving user commands and providing operational status of the reel 106 to the user.

A derrick 112 may also be positioned at the well site 104. However, it should be appreciated that other support structures may also be used. The derrick 112 includes a sheave wheel 114 or other support mechanism for suspending unspooled portions of the cable 108 downhole. Although FIG. 1 illustrates a land-based application of the reel system 100, the reel system 100 can also be used in offshore operations. The cable 108 may be an umbilical cable, which is a bundle of multiple lines, such as electrical lines and hydraulic lines for providing power, communication, and controls and transporting fluids, among other functions.

Figure 1B:
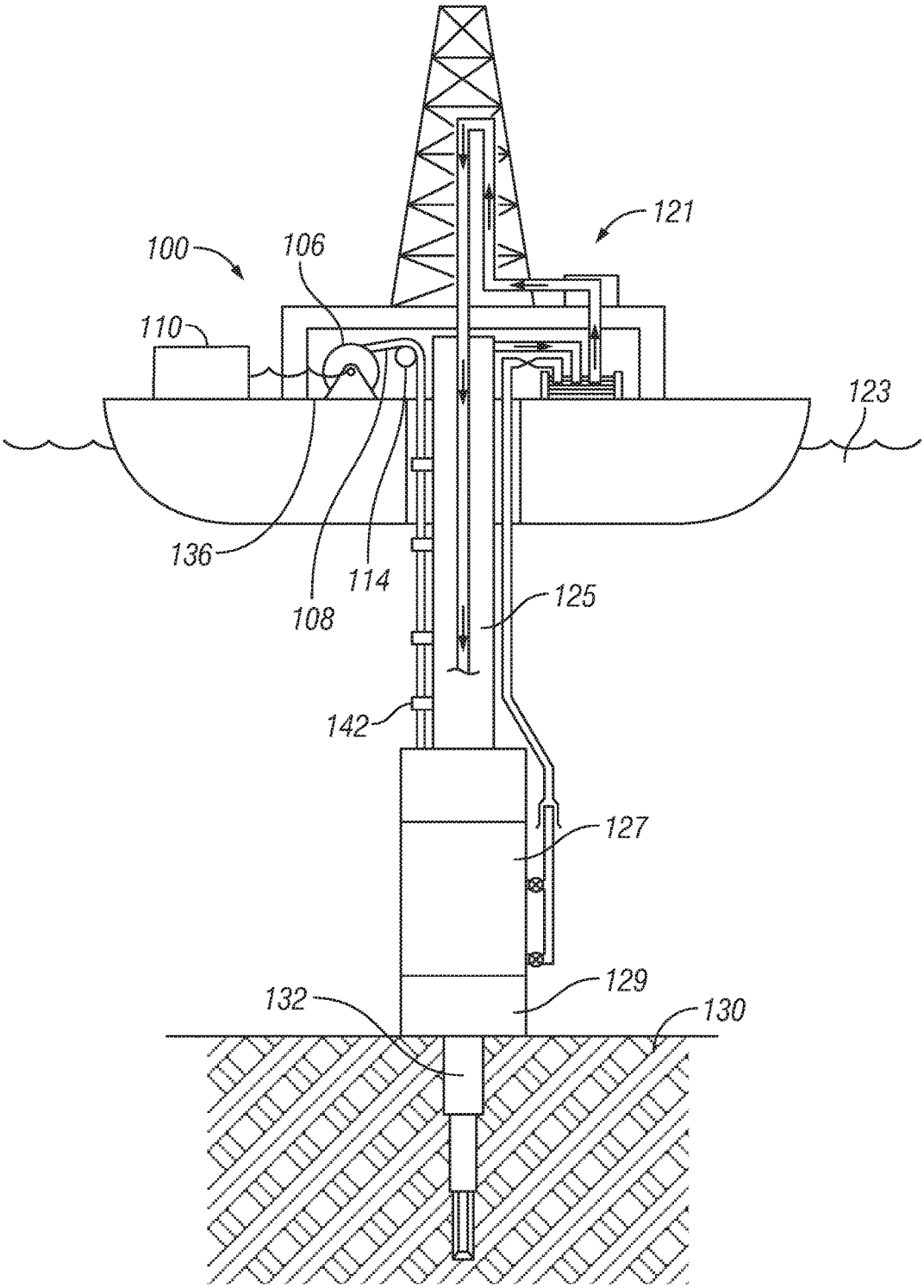
FIG. 1B depicts a schematic of an offshore well system including an electronic reel system in accordance with one or more embodiments.

FIG. 1B depicts a schematic view of an offshore well system utilizing the reel system 100, in accordance with one or more embodiments. A vessel 121 floating in the ocean 123 includes a drilling riser 125 extending down toward a blowout preventer stack 127. The blowout preventer stack 127 is connected with a subsea wellhead 129 installed on the seafloor 130. Casing 132 extends into the seafloor below the subsea wellhead 129 for the purpose of drilling an oil or gas well. The reel system 100 employing the reel 106 and the control system 110 may be located on the deck 136 of the vessel 121 with the cable 108 extending over a pulley or sheave wheel 114 and going down the side of the riser 125. The cable 108 may be one or more umbilicals to subsea devices such as choke or kill lines to the blowout preventer stack 127. The riser 125 may be a series of jointed pipes, and as the riser 125 is sequentially lowered into the ocean 123 to deploy the blowout preventer stack 127 to the seafloor 130, clamps 142 fasten the cable 108 to the drilling riser 125.

In one or more embodiments, the reel 106 of the reel system 100 is pneumatically or hydraulically driven and the control system 110 is an electronic control system in communication with the reel 106 for electronically controlling the reel 106.

Figure 2A:
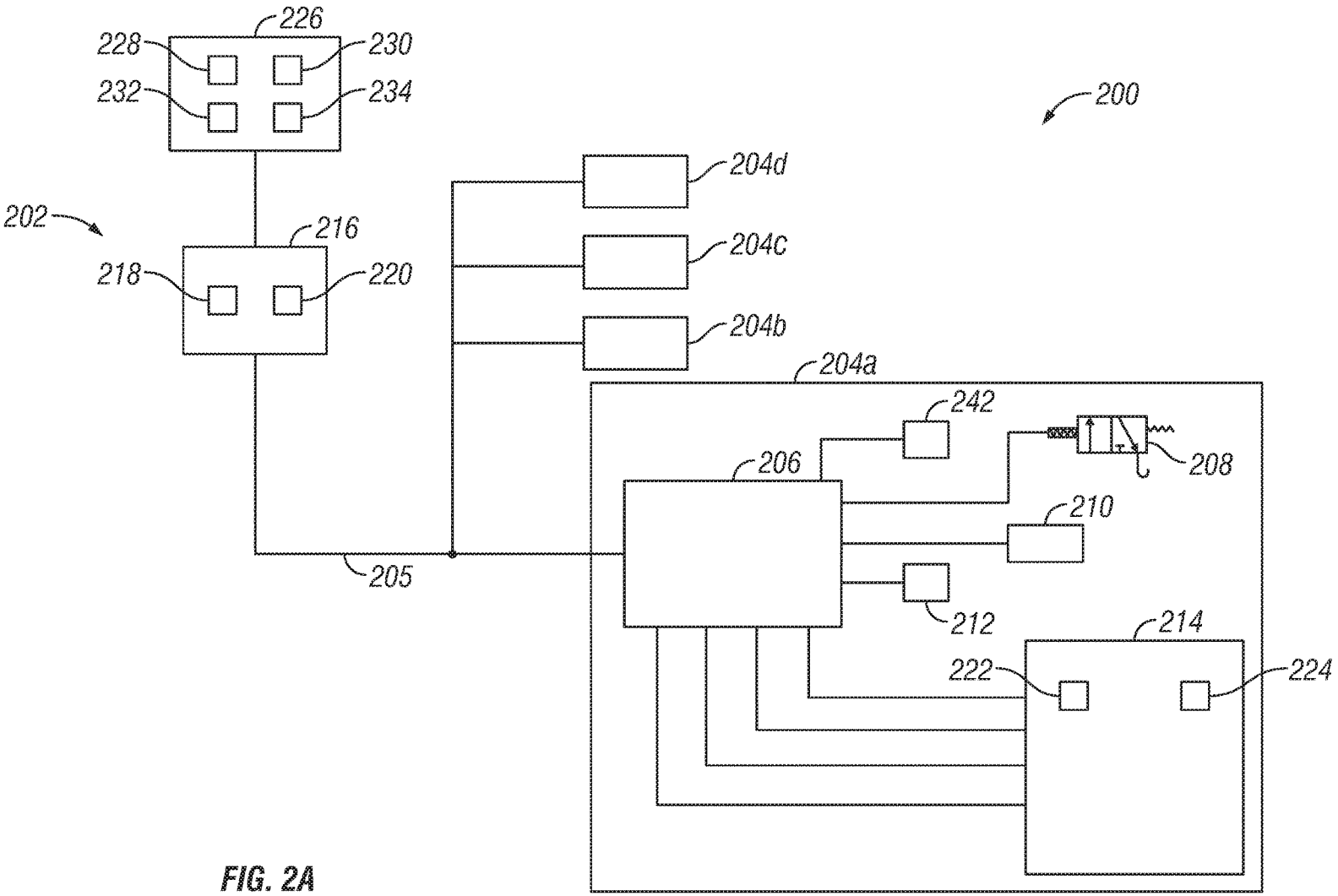
FIG. 2A depicts a block diagram of an electronically controlled pneumatic reel system in accordance with one or more embodiments.
Figure 2B:
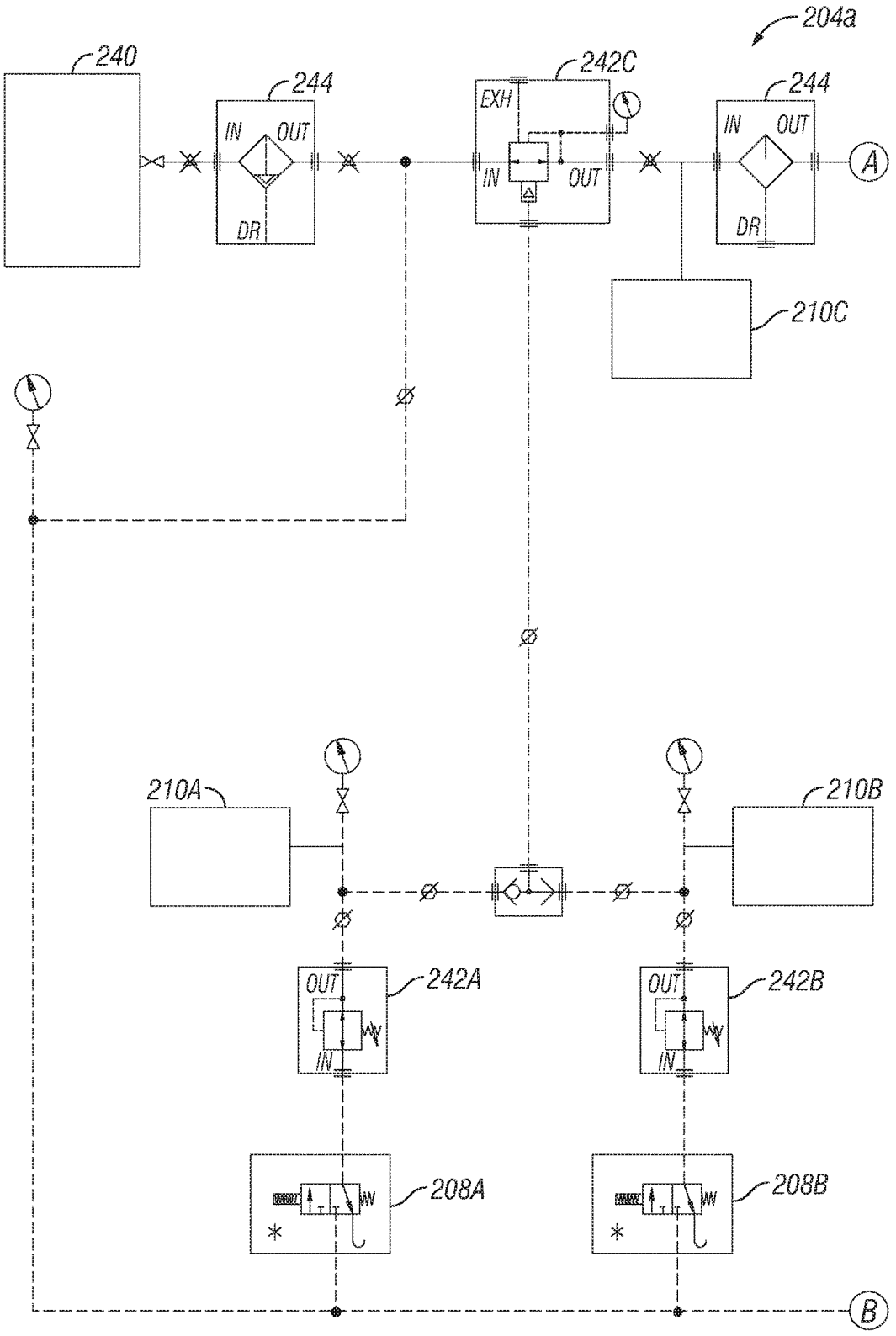
FIG. 2B depicts a schematic of the electronically controlled pneumatic reel system of FIG. 2A in accordance with one or more embodiments.
Figure 2B:
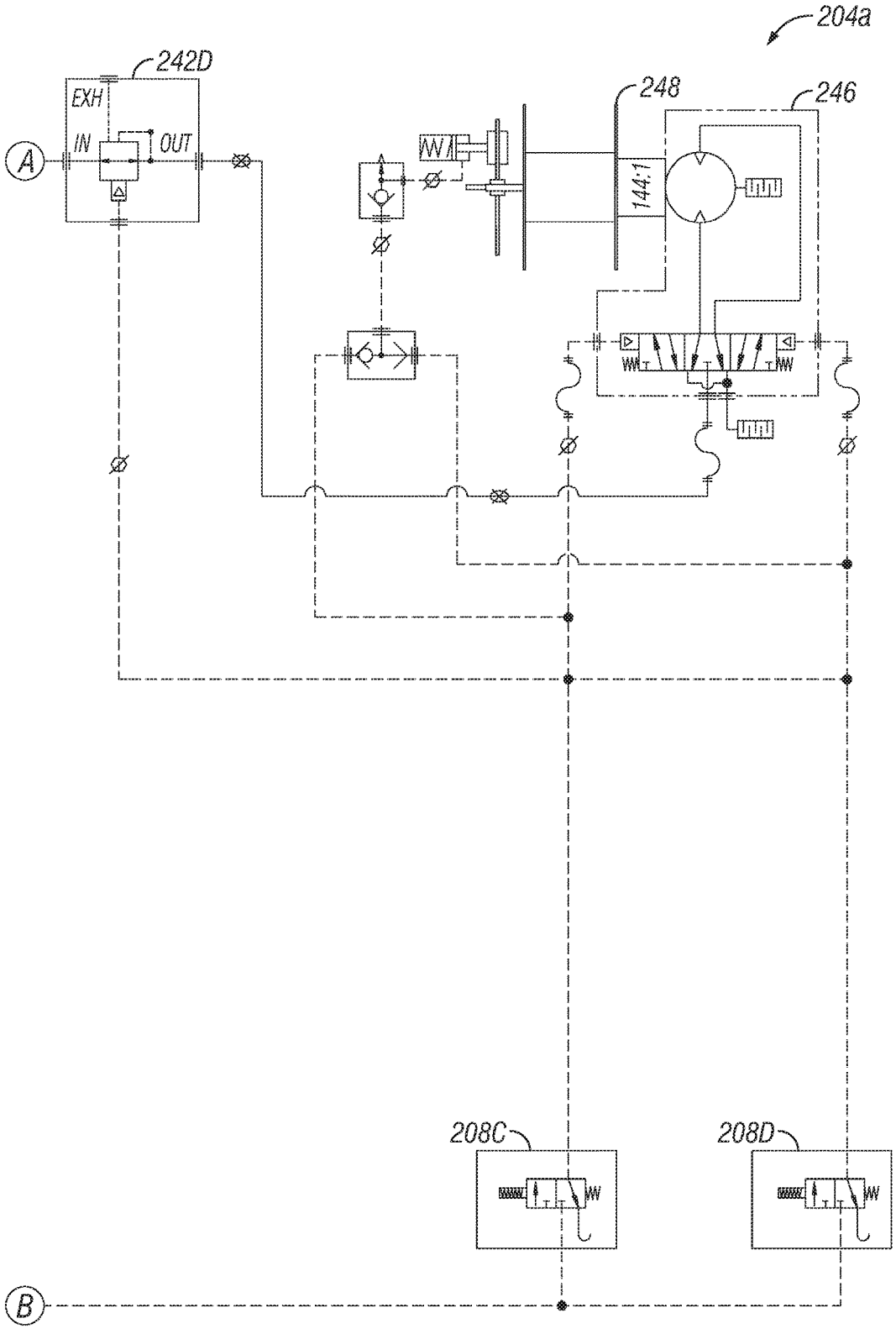

For example, FIG. 2A depicts a block diagram of an electronically controlled pneumatic reel system 200, in accordance with one or more embodiments. As shown in FIG. 2, the reel system 200 includes an electronic control system 202 and one or more reels 204, such as reels 204*a-d*. Although the components for the reels 204*b-d* are not shown, each of the reels 204*a-d* may include a controller 206 coupled to one or more control valves 208, one or more transducers 210, one or more sensors 212, a control panel 214, and one or more pressure regulators 242 as shown for the reel 204*a*. The electronic control system 202 may include a computer system 216 for processing commands, processing feedback from the transducers 210 and/or the sensors 212, and controlling the reels 204*a-d*. Among other things, the computer system 216 may include a processor 218 and a non-transitory machine-readable medium 220 (e.g., ROM, EPROM, EEPROM, flash memory, RAM, a hard drive, a solid state disk, an optical disk, or a combination thereof) capable of executing instructions to perform such tasks. As used herein, the term processor is intended to include devices such as a field programmable gate array (FPGA). The electronic control system 202 may also include a user interface 226 to operate the reels 204*a-d* either remotely from or locally at the reels 204*a-d*, and the electronic control system 202 may also be located remotely from or locally at the reels 204*a-d*.

The controller 206 includes one or more processors which receive commands from the control system 202 and send electrical control signals to the control valves 208 and/or the pressure regulators 242. The control valves 208, transducers 210, sensors 212, pressure regulators 242, and the control panel 214 are in electrical communication with the controller 206 to receive or send data and/or commands among these components. For example, the controller 206 decodes the command from the control system 202 to an electrical control signal and supplies the electrical control signal to the control valves 208 and/or the the pressure regulators 242 to control the rotation of the reel 204*a-d*. The control valves 208 may include solenoid valves and controllably couple a motor (not shown) that drives the reel 204*a-d* to a pneumatic or hydraulic pressure source (not shown) as further described herein with respect to FIG. 2B. The pressure regulators 242 are in fluid communication with the pressure source and the motor to regulate the pressure applied to the motor. The transducers 210 may include pressure transducers in fluid communication with the outlets of the pressure regulators 242 to provide pressure measurements of the output pressure of the respective pressure regulators 242 to the control panel 214 and/or the control system 202.

The control panels 214 may be located on each reel 204*a-d* and provide the option of receiving commands via an input device 222 (e.g., a keyboard, touchpad, button, dial, switch, etc.) or displaying the operational status for each reel 204*a-d* via an output device 224 (e.g., a monitor, screen, printer, digital or analog meter, etc.). The input device 222 may receive user controls for operating the reels 204*a-d*, and the user controls may include, but are not limited to, "Reel In", "Reel Out", "Normal Mode", or "Tensioning Mode". As used herein, "Normal Mode" refers to when the reel 204*a-d* is driven by a variable speed or torque, and "Tensioning Mode" refers to when the reel 204*a-d* is driven by a constant torque or speed to maintain tension on the cable 108 of FIGS. 1A and B while unspooling the reel 204*a-d*.

The sensors 212 are operable to provide closed-loop feedback to the control system 202 on the operation of each reel 204*a-d*, such as measuring a parameter indicative of a reel condition and communicating the parameter to the control system 202. The measurements from the sensors 212 may also be used to monitor the operation of the reels 204*a-d* from the user interface 226 and/or the control panel 214. The sensor 212 may include at least one of a speed sensor, a strain gauge, a pressure sensor, a load cell, etc. The sensors 212 may monitor various components of the reels 204*a-d* to measure parameters indicative of a reel condition for closed-loop feedback or monitoring the operation of the reel 204*a* as described herein. For example, the sensor 212 may monitor the sheave 114 of FIGS. 1A and B to measure the tension or torque applied to the cable 108 of FIGS. 1A and B. The sensor 212 may also monitor the sheave 114 to measure the rotational speed or rotational direction of the reel 204*a*. The load cell may be operable to output an electrical signal proportional to the pressure measured at the reel 204*a-d*. As used herein, a parameter indicative of the reel condition includes at least one of a reel pressure, reel position, reel load, reel tension, reel speed, extension length of the cable 108 of FIGS. 1A and B, and any other suitable parameter that may be used to monitor or control the reels 204*a-d*. The control system 202 may receive the measured parameters of the sensors 212 and control the rotation of the reels 204*a-d* based on the measured parameters. FIG. 2B shows a schematic of the pneumatic reel 204*a* included in the reel system 200, in accordance with one or more embodiments. Although this discussion is directed to the reel 204*a*, it is also applicable to the scope of the reels 204*b-d* depicted in FIG. 2A as well. As shown, the pneumatic reel 204*a* includes a pressure source 240, control valves 208A-D, transducers 210A-C, pressure regulators 242A-D, line filters 244, and a pneumatic motor 246. The pressure source 240 supplies pressure to the motor 246 to operate the pneumatic reel 204*a* and may include an air compressor. The pneumatic motor 246 is coupled to the drum 248 of the reel 204*a* to control the rotation of the drum 248. The line filters 244 may be used to remove contaminants from the pressurized fluid in the pneumatic reel 204*a*. Although not illustrated in FIG. 2B, the control valves 208A-D, the transducers 210A-C, the sensors 212, and the pressure regulators 242A, B, and D are in electrical communication with the controller 206 as depicted in FIG. 2A to control and/or monitor the operation of the reel 204*a* as described herein.

The control valves 208A-D are in fluid communication with the pressure source 240 and are used to select the operating mode of the reel 204*a* either via the control system 202 or the control panel 214 of FIG. 2A. For example, opening the control valve 208A provides pressure to the pressure regulator 242A, which is used to set a desired pressure to drive the motor 246. The pressure regulator 242A may variably control the pressure that drives the motor 246, e.g. from 30 psi (207 kPa) to 110 psi (758 kPa), in "Normal Mode" as described herein.

Opening the control valve 208B provides pressure to the pressure regulator 242B, which is used to set the "Tensioning Mode" pressure that drives the motor 246 while unspooling the cable 108 of FIG. 1 from the drum 248. The pressure set for "Tensioning Mode" on the pressure regulator 242B may depend on the tension required to unspool the cable 108. As an example, the pressure set for "Tensioning Mode" may be set to the maximum tension which is allowed on the cable 108 in order to pull the cable 108 off the reel while the motor 246 is in the "Reel In" position without damaging the cable 108 or the motor 246. In "Tensioning Mode," the motor 246 may be in a slip mode and provide constant back tension on the reel drum 248 in order to avoid sag or slack in the cable 108 while deploying the cable 108 in a wellbore.

Opening the control valve 208C sets the motor 246 to the "Reel In" mode to wind the cable 108 on the drum 248. While set in "Reel In" mode, pressure may be output through either the pressure regulator 242A or the pressure regulator 242B to drive the motor 246. Opening the control valve 208D sets the motor 246 to the "Reel Out" mode to unspool the cable 108 on the drum 248. While set in "Reel Out" mode, pressure may be output through either the pressure regulator 242A or the pressure regulator 242B to drive the motor 246.

The pressure regulators 242A, B, and D may be electrically coupled to the controller 206 to allow the control system 202 or the control panel 214 to set the pressure output for the respective pressure regulators 242A, B, and D. The pressure regulators 242A, B, and D may each have an input device, such as a dial or knob, located at the control panel 214 to manually set the pressure output for the respective pressure regulators 242A, B, and D. As discussed herein, the pressure regulator 242A sets the pressure setpoint for "Normal Mode," whereas the pressure regulator 242B sets the pressure setpoint for "Tensioning Mode." The pressure regulator 242C is also used to control the pressure supplied from the pressure source 240 and set by either of the pressure regulators 242A and B. As shown, the pressure regulator 242C is in fluid communication with the pressure source 240 and the pressure regulators 242A and B. The pressure regulator 242D may be used to turn the reel 204*a* on or off to suspend or start reeling operations.

The transducers 210A-C are in fluid communication with the outlets of the pressure regulators 242A-C, respectively, to provide feedback about the output pressure of the pressure regulators 242A-C to the control system 202. The transducer 210A-C may also provide pressure measurements to the control panel 214 and/or the user interface 226 of FIG. 2A to monitor the pressure setpoints for "Normal Mode," "Tensioning Mode," and the output pressure of the pressure regulator 242C.

Referring to FIGS. 2A and 2B, in one or more embodiments, the functions of these components can be performed by various other components and combination of components, as would be known to one skilled in the art. Thus, the example components can be replaced by such other components without straying from the scope of the disclosure. Various instrumentation and electronics devices can be mounted on the reels 204*a-d* as well as those which are suitable for hazardous area installation. The instrumentation provides for either local or remote control of the control valves 208 and feedback of conditions of the reels 204*a-d*, including position, load, motor status, among others. In some embodiments, the feedback happens in real time or quasi-real time.

The user interface 226 may be an additional computer system including a processor 228, an output device 230 (e.g., a monitor, screen, printer, etc.), an input device 232 (e.g., a keyboard, touchpad, mouse, etc.), and a non-transitory machine-readable storage media 234 (e.g., ROM, EPROM, EEPROM, flash memory, RAM, a hard drive, a solid state disk, an optical disk, or a combination thereof). However, the user interface 226 may be implemented in a wide variety of forms including, but not limited to, an input device and output device integrated with the computer system 216 for the control system 202, a portable computer or tablet that communicates with the control system 202, and a remote computer in communication with the control system 202 via a wireless link and/or a wired computer network. In embodiments, the control panel 214 is local to the reels 204*a-d* and the electronic control system 202 is remotely located from the reels 204*a-d*. The control system 202 is in communication with each reel 204*a-d* so as to be able to energize the pneumatic control valves 208 that control the supply of pneumatic pressure to the reels 204*a-d*, thereby rotating the reels 204*a-d* in either direction or stopping the reels 204*a-d*.

The control system 202 is in communication with the controller 206 to control operation of multiple reels 204*a-d* at once, in a synchronized or offset manner The control system 202 may also be operable to control the rotation of the reels 204*a-d* individually, collectively, synchronously, or according to a programmed protocol. For example, the control system 202, upon receiving a command, can control multiple reels 204*a-d* to rotate, thereby unspooling multiple cables 108 synchronously. The command may be a single command or multiple commands and may be user commands input from the user interface 226 or automatically generated commands. The control system 202 may also include programmed protocol to control the reels 204*a-d*. For example, the programmed protocol, when executed, drives several reels 204*a-d* at separate or different rotational rates or directions. Such a protocol can be executed based on an input to the control system 202 from the user interface 226. A wide variety of protocols for driving one or a plurality of reels 204*a-d* can be programmed and executed by the control system 202. Execution of such protocols can come from user input to the control system 202 or upon preprogrammed conditions, in which the control system 202 can automatically execute one or more protocols. The control system 202 can also provide status reports of the one or more reels 204*a-d* to a reel operator, such as displaying on the user interface 226 the reel speed, reel tension, or extension length of the cable 108. The control system 202 can communicate with the reels 204 via a communication network 205, which provides a wireless and/or wired connection. The communication network 205 may include any suitable communication network for control systems such as PROFIBUS or PROFINET.

Figure 3:
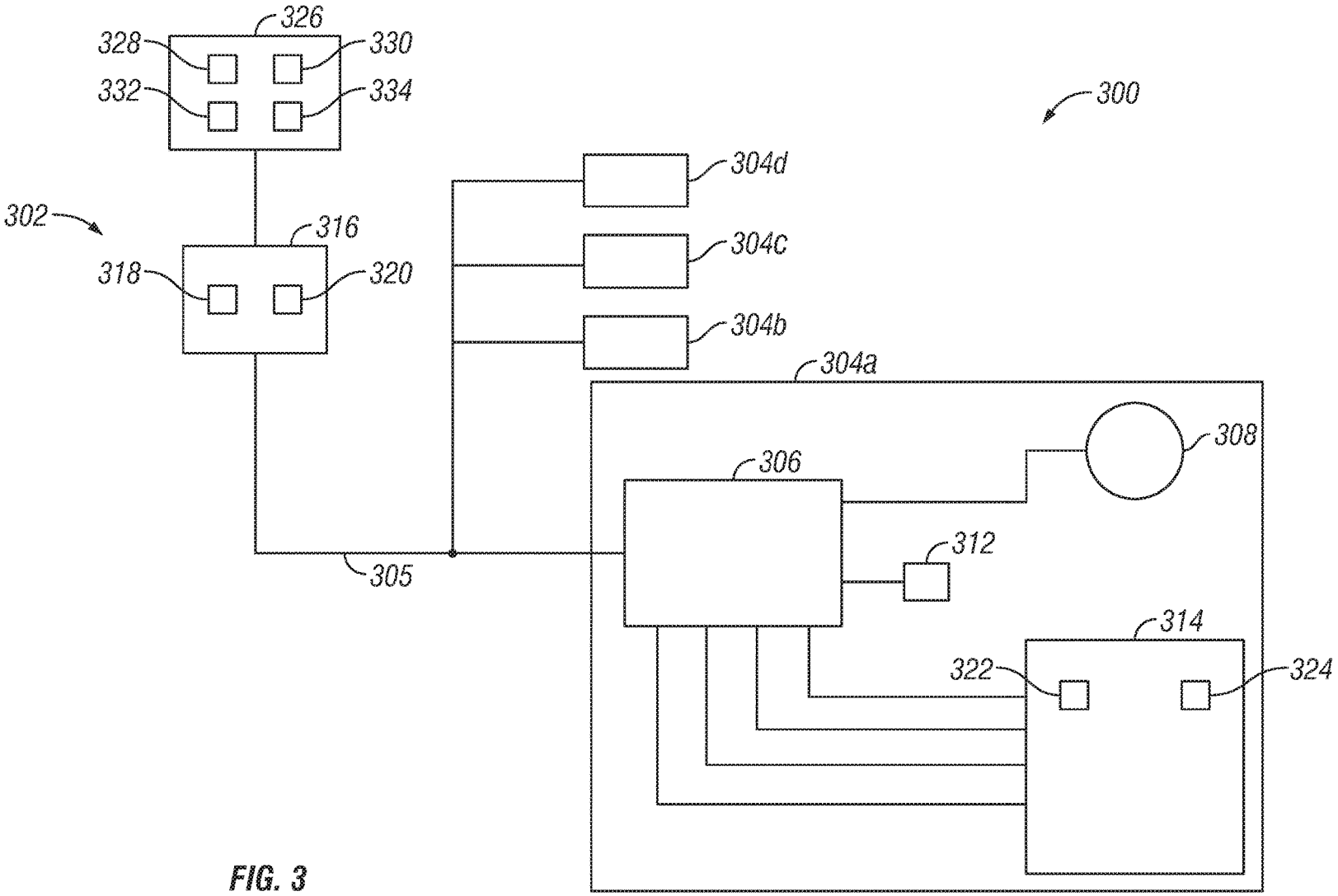
FIG. 3 depicts a block diagram of an electrically driven and electronically controlled reel system in accordance with one or more embodiments.

In one or more embodiments, the reel 106 of the reel system 100 is electrically driven by an electric motor and controlled by the electronic control system 110. For example, FIG. 3 shows a block diagram of an electrically driven reel system 300, in accordance with one or more embodiments. The system 300 includes an electronic control system 302 and one or more reels 304*a-d*. The electronic control system 302 may include a computer system 316 as described herein with respect to FIG. 2. Although the components for the reels 304*b-d* are not shown, each of the reels 304*a-d* may include a controller 306 coupled to an electric motor 308, a sensor 312, and a control panel 314 as illustrated for reel 304*a*. The controller 306 includes one or more processors which receives a command from the control system 302 and sends control signals to the motor 308, thereby driving the motor 308. The controller 306 may decode the command from the control system 302 to an electrical control signal and supply the electrical control signal to the motor 308 to control the rotation of the reel 304*a-d*. The motor 308 is coupled to the reel 304*a-d* to control the rotational rate and direction of the reel 304*a-d*. The motor 308 drives rotation of the reel 304*a-d*, thereby unspooling or spooling the cable 108. In contrast to the pneumatically or hydraulically driven reels 204 of FIG. 2, the reel system 300 uses the electric motors 308 to operate the reels 304*a-d* and does not use a pressure source to supply the air/pressure to operate the reels 304*a-d*.

The control panel 314 provides the option of receiving commands via an input device 322 (e.g., a keyboard, touchpad, button, dial, switch, etc.) or displaying the operation status for each reel 304*a-d* via an output device 324 (e.g., a monitor, screen, printer, digital or analog meter, etc.). The input device 322 may receive user controls, which may include "Reel In", "Reel Out", "Normal Mode", or "Tensioning Mode", for operating the reel 304*a-d* as described herein with respect to FIG. 2.

The sensors 312 provide closed-loop feedback to the control system 302, such as measuring a parameter indicative of a reel condition and communicating the parameter to the control system 302. As used herein, the parameter indicative of the reel condition may also include at least one of a horsepower of the motor 308 and a frequency of rotation of the motor 308.

The electronic control system 302 may include a user interface 326 to operate the reels 304*a-d* either remotely or locally at the reel 304*a-d*, and the electronic control system 302 may also be located remotely or locally at the reel 304*a-d*. The user interface 326 may be computer system as described herein with respect to FIG. 2 (such as the computer system 226) or an input device and output device integrated with the computer system 316 for the control system 302.

The control system 302 is in communication with the controller 306 to control operation of one or multiple reels 304*a-d* at once, in a synchronized or offset manner The control system 302 may also be operable to control the rotation of the reels 304*a-d* individually, collectively, synchronously, or according to a programmed protocol. For example, the control system 302, upon receiving a command, can control multiple reels 304*a-d* to rotate, thereby unspooling multiple cables 108 synchronously. The command may be a single command or multiple commands and may be user commands input from the user interface 326 or automatically generated commands. The control system 302 may include a programmed protocol to control the reels 304*a-d*. For example, the programmed protocol, when executed, drives several reels 304*a-d* at separate or different rotational rates or directions. Such a protocol can be executed based on a single user input to the control system 302 from the user interface 326. A wide variety of protocols for driving one or a plurality of reels 304*a-d* can be programmed and executed by the control system 302. Execution of such protocols can come from user input to the control system 302 or upon preprogrammed conditions, in which the control system 302 can automatically executes one or more protocols. The control system 302 can also provide status reports of the one or more reels 304*a-d* to the reel operator, such as displaying, on the user interface 326, the reel speed, reel tension, or extension length of the cable 108. The control system 302 can communicate with the reels 304 via a communication network 305, which provides a wireless and/or wired connection. The communication network 305 may include any suitable communication network for control systems such as PROFIBUS or PROFINET.

Although FIGS. 2A and 2B are directed to a pneumatically driven reel system, it should be appreciated that the scope of the electronically controlled pneumatic reel system 200 may also apply to a hydraulically driven reel system as well. It should also be appreciated that a reel system may include any one or combination of electrically, pneumatically, or hydraulically driven reels, so that one or more of the reels 204 and one or more of the reels 304 are electronically controlled by the control system 110 as described herein with respect to FIGS. 1A-3.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. An electronically controlled reel system for oilfield operations, comprising:

at least two reels;

a first motor coupled to a first controller and configured to rotate a first reel;

a second motor coupled to a second controller and configured to rotate a second reel; and a control system in communication with the first and the second controllers, wherein the first controller is configured for receiving a first signal from a first sensor and switching operation of the first motor between a normal mode of operation and a tensioning mode of operation in response to the first signal, wherein the normal mode of operation comprises driving the first reel with variable torque and the tensioning mode of operation comprises driving the first reel with constant torque, wherein the second controller is configured for receiving a second signal from a second sensor; and switching operation of the second motor between a normal mode of operation and a tensioning mode of operation in response to the second signal, wherein the normal mode of operation comprises driving the second reel with variable torque and the tensioning mode of operation comprises driving the second reel with constant torque, wherein the control system controls operations of the first and the second controllers according to a programmed protocol to drive the at least two reels at separate or synchronous rotational rates or directions.

2. The system of claim 1, wherein the first and second motors are electric motors.

3. The system of claim 1, wherein the first and second motors are pneumatic motors.

4. The system of claim 3, wherein the second controller is configured to change operation of the second motor between a normal mode of operation and a tensioning mode of operation.

5. The system of claim 1, wherein the first sensor is configured to detect a parameter indicative of a reel condition and transmit a signal to the first controller wherein the first controller is configured to control the first motor in response to the signal.

6. The system of claim 5, wherein the parameter indicative of the reel condition comprises at least one of a reel pressure, a reel tension, a reel speed, an extension length of a cable, a rotational frequency of the first motor, and a horsepower of the motor.

7. The system of claim 1, comprising a local control panel configured to receive a command to control the first motor.

8. The system of claim 5, wherein the first sensor comprises at least one of a speed sensor, a strain gauge, a pressure sensor, a load cell.

9. A method of controlling a reel system for an oilfield operation, comprising:

receiving a first signal from a first sensor with a first controller;

switching operation of a first motor between a normal mode of operation and a tensioning mode of operation in response to the first signal with the first controller, wherein the normal mode of operation comprises driving a first reel with variable torque and the tensioning mode of operation comprises driving the first reel with constant torque, receiving a second signal from a second sensor with a second controller; and switching operation of a second motor between a normal mode of operation and a tensioning mode of operation in response to the second signal with the second controller, wherein the normal mode of operation comprises driving a second reel with variable torque and the tensioning mode of operation comprises driving the second reel with constant torque, wherein a control system is in communication with the first and the second controllers to controls operations of the first and the second controllers according to a programmed protocol to drive the first and second reels at separate or synchronous rotational rates or directions.

10. The method of claim 9, wherein switching the operation of the first motor comprises controlling a solenoid valve.

11. The method of claim 9, comprising receiving a command to switch the operation of the first motor from a user interface coupled to the first controller.

12. The method of claim 9, wherein switching the operation of the first and the second motors comprises controlling the first controller and the second controller with the control system.

13. The method of claim 9, wherein the first signal from the first sensor is indicative of at least one of a reel pressure, a reel tension, a reel speed, an extension length of a cable, a rotational frequency of the first motor, and a horsepower of the first motor.

14. A system of electronically controlling reels to deploy one or more umbilicals to a drilling equipment, comprising:

a first reel system, comprising:

a first motor configured to rotate a first reel; and a first controller configured to control operation of the first motor;

a second reel system, comprising:

a second motor configured to rotate a second reel; and a second controller configured to control operation of the second motor;

wherein the first controller is configured for receiving a first signal from a first sensor and switching operation of the first motor between a normal mode of operation and a tensioning mode of operation in response to the first signal, wherein the normal mode of operation comprises driving the first reel with variable torque and the tensioning mode of operation comprises driving the first reel with constant torque, wherein the second controller is configured for receiving a second signal from a second sensor; and switching operation of the second motor between a normal mode of operation and a tensioning mode of operation in response to the second signal, wherein the normal mode of operation comprises driving the second reel with variable torque and the tensioning mode of operation comprises driving the second reel with constant torque, and a computer system communicatively coupled to the first reel system and the second reel system to control rotation of the first reel and the second reel according to a programmed protocol to drive the first and second reels at separate or synchronous rotational rates or directions thereby unspooling the one or more umbilicals.

15. The system of claim 14, wherein the first sensor is configured to measure a first parameter indicative of a reel condition of the first reel, wherein the first controller and the computer system control rotation of the first reel in response to the first parameter.

16. The system of claim 14, wherein the second sensor is configured to measure a second parameter indicative of a reel condition of the second reel, wherein the second controller and the computer system control the rotation of the second reel in response to the second parameter.

* * * * *